US006668774B1

(12) United States Patent
Dauer et al.

(10) Patent No.: US 6,668,774 B1
(45) Date of Patent: Dec. 30, 2003

(54) NON-CONTACTING APPARATUS FOR DETERMINING RELATIVE ROTARY POSITION OF TWO ELEMENTS

(75) Inventors: Kenneth J. Dauer, Avon, NY (US); David J. Trapasso, Bloomfield, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/234,509

(22) Filed: Sep. 4, 2002

(51) Int. Cl.[7] ..... F01L 1/34

(52) U.S. Cl. ..... 123/90.15; 123/90.12; 123/90.17; 464/160

(58) Field of Search ..... 123/90.1, 90.12, 123/90.15, 90.16, 90.17; 464/1, 2, 160

(56) References Cited

U.S. PATENT DOCUMENTS 5,522,352 A * 6/1996 Adachi et al. ..... 123/90.15
6,429,647 B1 * 8/2002 Nicholson ..... 324/207.2
6,588,404 B1 * 7/2003 Mathews ..... 123/479

OTHER PUBLICATIONS

Mathews et al., Target Wheel Tooth Detection, US patent application Publication, US 2003/0000498A1, Jan. 2, 2003.*

* cited by examiner

*Primary Examiner*—Thomas Denion
*Assistant Examiner*—Ching Chang
(74) *Attorney, Agent, or Firm*—Patrick M. Griffin

(57) ABSTRACT

An assembly having first and second coaxially-related elements oscillatingly-rotatable about a mean angular relationship therebetween. An axial well in one element is threaded and an axial well in the other element is splined. A pin having threads on a first end and splines on the second end is disposed on both the threads and splines of the two elements. A Hall-effect magnetic field strength sensor is disposed coaxially adjacent to the assembly. A permanent magnet mounted on an end of the pin adjacent the Hall-effect sensor creates a magnetic response therein. As the angular relationship between the two elements changes, the pin turns with the splined element, the threads simultaneously displacing the pin and magnet axially of the assembly, thereby changing the intensity of the field experienced by the sensor and the signal output therefrom in proportion to the relative angular position of the two elements. The invention is especially useful for continuous monitoring and control of the advance and retard timing of an engine cam phaser.

5 Claims, 4 Drawing Sheets

NON-CONTACTING APPARATUS FOR DETERMINING RELATIVE ROTARY POSITION OF TWO ELEMENTS

TECHNICAL FIELD

The present invention relates to mechanisms for determining relative angular position between two coaxially-related elements; more particularly, to mechanisms for continuously determining the instantaneous angular relationship between a camshaft pulley and a camshaft in a cam phaser apparatus for an internal combustion engine; and most particularly, to apparatus for making such instantaneous determination without contact between the two coaxially-related elements.

BACKGROUND OF THE INVENTION

In apparatus including first and second elements having coaxial relative rotation therebetween about a mean angular position, the need arises to determine changes in the relative angular position in either direction. An especially demanding application is one in which both elements are being simultaneously rotated on a common shaft. Just such a situation occurs in variable cam phasing systems for internal combustion engines. The angular relationship between the camshaft pulley and the camshaft itself is variable and must be determined at all times, but conveying a signal from the rotating apparatus via prior art means is difficult and cumbersome.

One known approach is to use a conventional position sensor, resistive or otherwise, mounted on the rotating cam phaser, and to convey a signal to an engine control module (ECM) via slip rings. This solution is expensive to implement and is prone to failure.

Another known approach is to use digital Hall-effect proximity sensors to detect the passing of timing features on each of the elements. By measuring the time interval therebetween, the angular relationship can be inferred. This solution, while theoretically sound, is complicated to implement because the angular velocity of the engine can vary within a single revolution of the cam phaser, causing an error in the apparent time phase measurement.

What is needed is a simple, inexpensive, and reliable means for determining the phase relationship of first and second coaxially mounted rotatable elements in an assembly, especially a cam phaser.

It is a principal object of the present invention to provide a simplified and reliable measurement of the phase relationship of such elements.

It is a still further object of the invention to provide such measurement proximately and without electrical connection to the assembly.

SUMMARY OF THE INVENTION

Briefly described, apparatus in accordance with the invention includes a Hall-effect magnetic field strength sensor disposed coaxially adjacent to an assembly having first and second coaxially-related elements oscillatingly-rotatable about a mean angular relationship therebetween. One of the elements is provided with a threaded axial bore or stud, and the other of the elements is provided with a longitudinally-splined axial bore. A pin having threads on a first end and splines on the second end is matingly disposed on both the threads and splines, respectively, of the two coaxially-related elements. A permanent magnet is mounted on an end of the pin adjacent the Hall-effect sensor, creating a magnetic response therein. As the angular relationship between the two elements changes, the pin turns with the splined element. However, the turning pin is simultaneously displaced axially of the assembly by the threads, thus displacing the magnet with respect to the sensor and thereby changing the intensity of the field experienced by the sensor. Thus, the sensor output is a continuous signal representing the intensity of magnetic field which is directly proportional to the relative angular position of the two elements. Because the magnet and sensor are coaxially disposed, rotation of the magnet, as occurs, for example, in a cam phaser application, is irrelevant. In such an application, the sensor signal is provided to an engine control module for continuous monitoring and control of the advance and retard timing of engine intake valve opening and closing.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
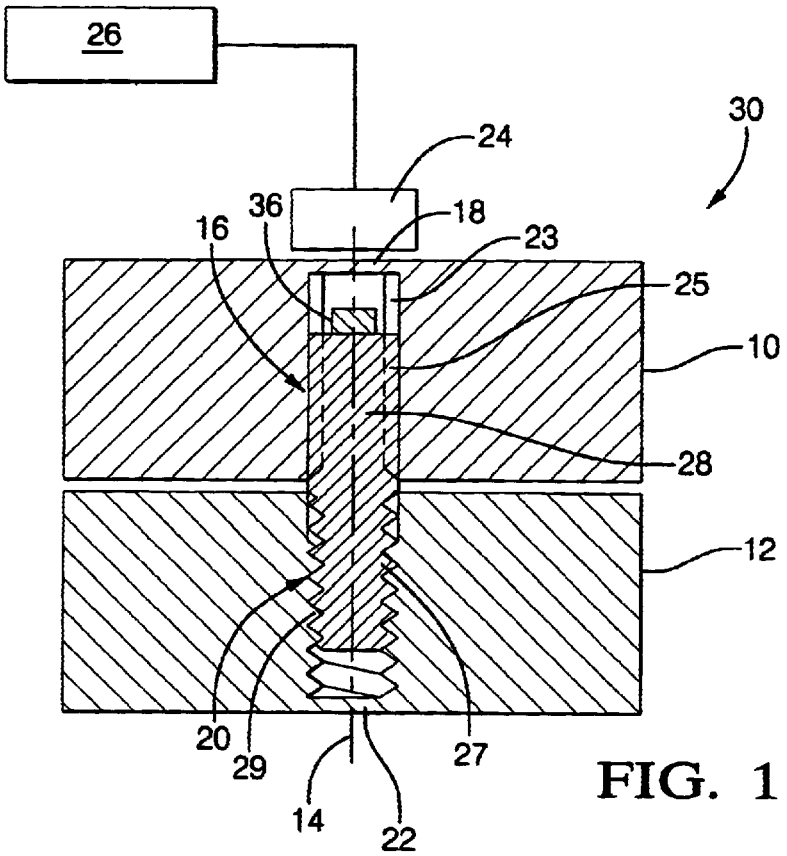
FIG. 1 is a schematic cross-sectional view of a first embodiment of an apparatus in accordance with the invention.
Figure 2:
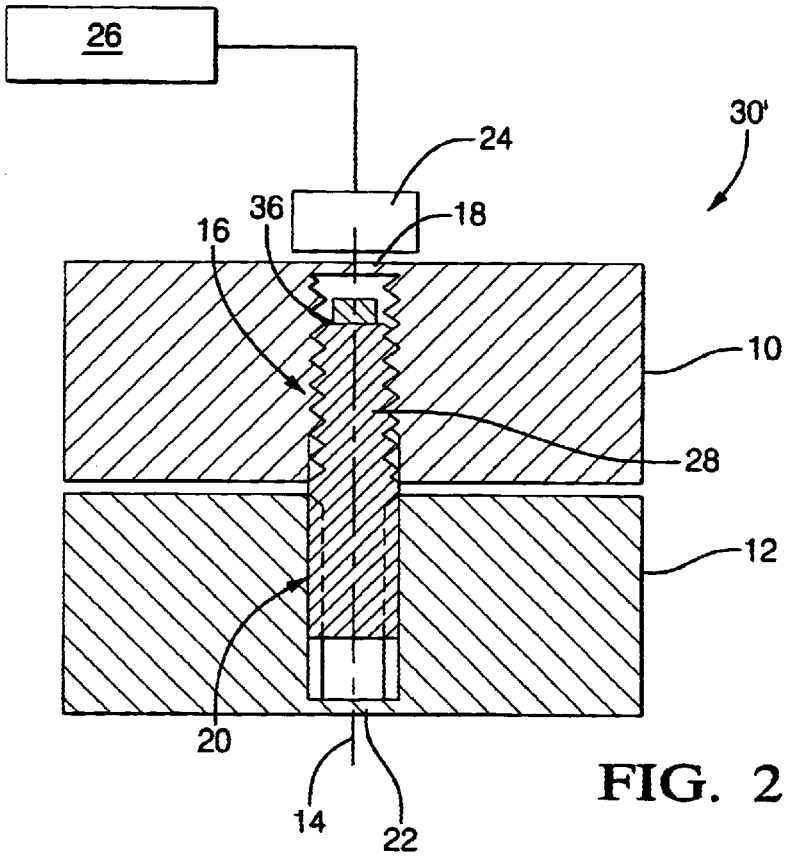
FIG. 2 is a schematic cross-sectional view of a second embodiment of an apparatus in accordance with the invention.
Figure 3:
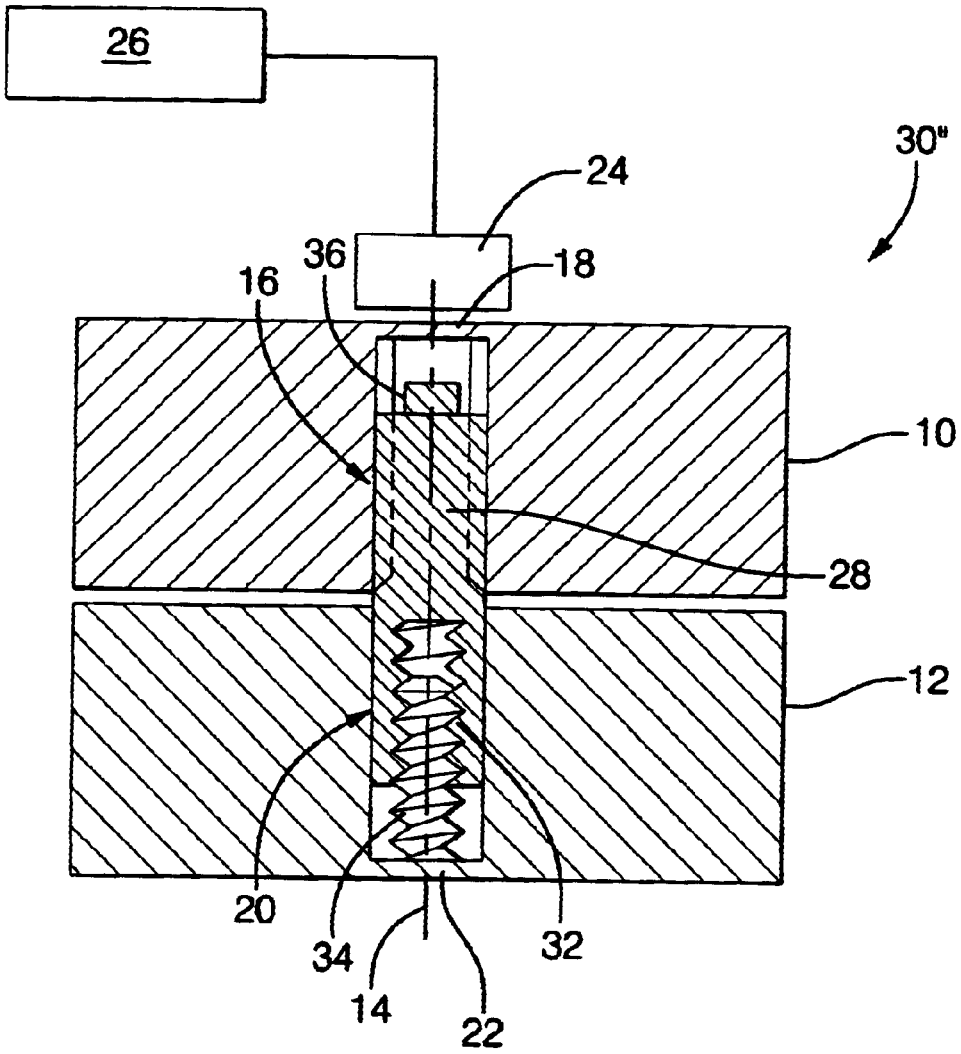
FIG. 3 is a schematic cross-sectional view of a third embodiment of an apparatus in accordance with the invention.

Referring to FIGS. 1 through 3, first element 10 and second element 12 are disposed coaxially on axis 14. First element 10 is formed of a non-ferromagnetic material, for example, a polymeric resin, aluminum, or certain stainless steels. First element 10 is provided with a first axial well 16 having a thin bottom wall 18. Second element 12 is provided with a second axial well 20 having a bottom wall 22. Coaxially disposed closely adjacent well bottom wall 18 but not in contact with element 10 is a ratiometric Hall-effect sensor 24, a semiconductor device which produces a voltage proportional to the local magnetic field strength. One such device is the A3515LUA, available from Allegro Microsystems, Inc., Worcester, Mass. 01615, USA. Sensor 24 may be connected to a control means 26, for example, an engine control module.

Extending into both wells 16 and 20 and axially moveable therein is a pin 28, splined along one end portion and threaded along the opposite end portion. The only differences among the embodiments shown in FIGS. 1–3 is the male/female relationships of the threads and splines and their placement in either element 10 or element 12. All are equivalent in function in accordance with the invention.

In first embodiment 30 (FIG. 1), well 16 is female-splined with longitudinal splines 23, running parallel to axis 14 and pin 28 is male-splined with longitudinal splines 25 in element 10, and well 20 is female-threaded with threads 27 and pin 28 is male-threaded with threads 29 in element 12.

In second embodiment 30' (FIG. 2), well 16 is female-threaded and pin 28 is male threaded, and well 20 is female-splined and pin 28 is male-splined.

In third embodiment 30" (FIG. 3), well 16 is female-splined and pin 28 is male-splined as in embodiment 30. Pin 28 has a threaded axial bore 32, and well 20 is provided with a threaded stud 34 axially mounted on wall 22.

In each of embodiments 30,30',30", a permanent magnet 36 is disposed in well 16 on the end of pin 28 adjacent sensor 24. By definition, an angular relationship with respect to axis 14 exists between elements 10 and 12. At any given angular relationship, sensor 24 is exposed to a magnetic field produced by magnet 36 and sends a signal to control means 26 proportional to the field strength. If elements 10,12 are rotated with respect to each other about axis 14 to assume a different angular relationship, pin 28 must rotate with the longitudinal splined element. The rotation causes pin 28 to turn along threads 27,29 in the threaded element by an amount equal to the angular change between elements 10,12. Magnet 36 is thereby axially displaced, according to the pitch of the threads, either toward or away from sensor 24, depending upon the direction of relative rotation; the field experienced by sensor 24 is either increased or decreased, and the signal sent to control means 26 is either increased or decreased proportionally. The device may be readily calibrated in known fashion to relate relative angular position to signal strength. Note that, because all motions are relative to axis 14 and the magnetic field is symmetrical about axis 14, combined rotation of elements 10,12 about axis 14 is irrelevant and does not affect the signal even when the sensor is stationary.

Figure 4:
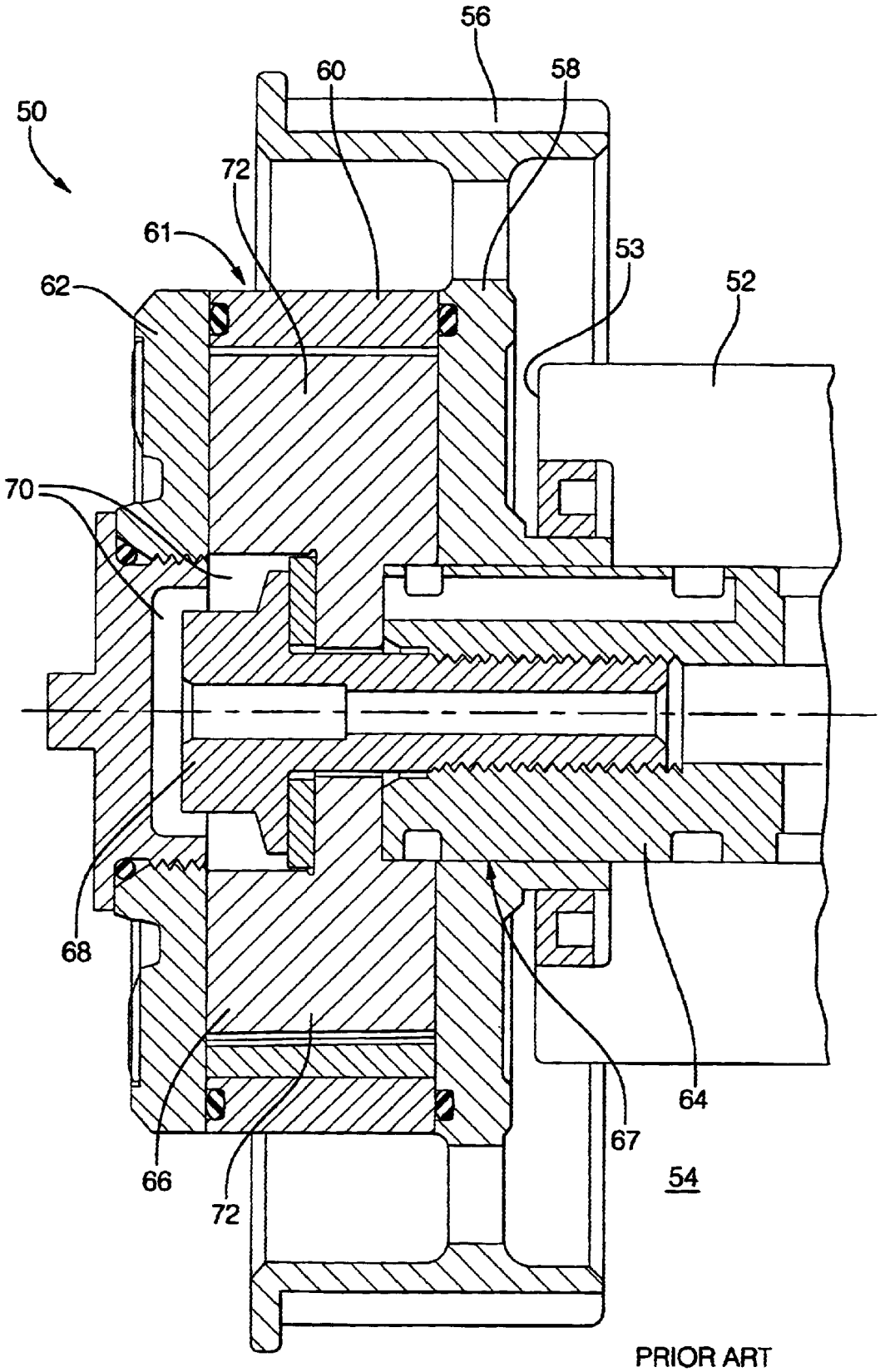
PRIOR ART FIG. 4
FIG. 4 is a cross-sectional view of a prior art vane-type cam phaser.

Referring to FIG. 4, a prior art vane-type cam phaser 50 is well known in the automotive arts for controllably altering the phase relationship between the crankshaft (not shown) and the camshaft 52 of an internal combustion engine 54, the motion and phase of the crankshaft being transmitted to the phaser via a crankshaft pulley 56. Phaser 50 is rotatably mounted on an end 53 of camshaft 52. Pulley 56 is integrally assembled with phaser hub 58, body 60, and cover 62 which therefore rotate as a crankshaft subassembly 61 in phase according to pulley 56. A rotor hub 64 is pressed into a recess in the end of camshaft 52, supporting a multi-vaned rotor 66 connected to hub 64 via a hollow bolt 68 threaded into hub 64, forming a camshaft subassembly 67 having an angular relationship to crankshaft subassembly 61. Control hydraulic fluid in the form of pressurized engine oil flows from ports in the camshaft (not shown) axially through bolt 68, into gallery 70, and thence into galleries formed between vanes 72 and stator lobes (not visible in this elevational cross-sectional view) to urge rotor subassembly to a different angular position with respect to crankshaft subassembly 61. Other mechanisms, which need not be addressed here but are well known in the art, act to urge the rotor assembly in the opposite direction as required. Thus, in normal operation of the cam phaser, there is relative rotational motion between cover 62 and bolt 64, in both rotational directions, about a mean angular position.

Figure 5:
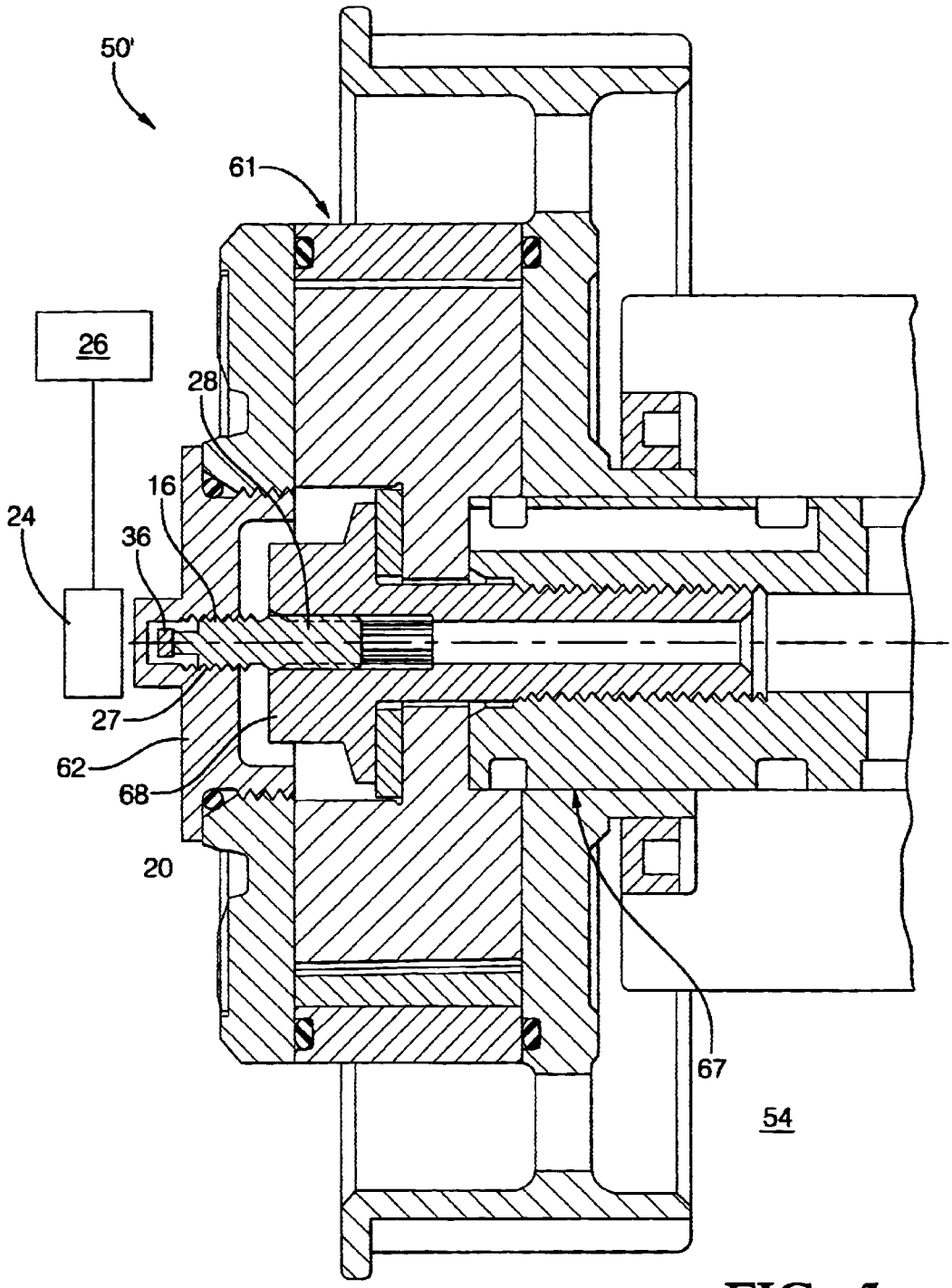
FIG. 5 is a cross-sectional view of a vane type cam phaser in accordance with the invention.

Referring to FIG. 5, an improved cam phaser 50' is shown, substantially identical in all respects to prior art phaser 50 except as shown and discussed below. A non-contacting apparatus is included in phaser 50' for sensing and signaling changes in the relative angular position of subassembly 61 with respect to subassembly 67. The embodiment shown is equivalent to embodiment 30' shown in FIG. 2. Well 20 formed in the head of bolt 68 is female-splined, and pin 28 is male splined. A new well 16 is formed in cover 62 and is female-threaded. Pin 28 is male threaded. Threads may be either right-or left-handed. A permanent magnet 36 is mounted on the outer end of pin 28. A Hall-effect sensor 24 is mounted closely adjacent cover 62 but preferably not in contact with cover 62, which in operation may be rotated at several hundreds or thousands of revolutions per minute. Sensor 24 is connected to engine control module 26. Pin 28, being spline-mounted in bolt 68, rotates with camshaft subassembly 67 and is driven axially by threads 27 in well 16 toward and away from sensor 24.

Thus, the invention provides a simple, inexpensive, reliable, non-contacting means for determining and measuring changes in angular position between first and second coaxially disposed elements.

While the embodiment described in FIG. 5 is shown as being equivalent to embodiment 30' shown in FIG. 2, it is understood that improved cam phase 50' may be shown as being equivalent to embodiment 30' or 30" and fall within the scope of the invention.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. Apparatus for determining and measuring changes in relative rotational position, comprising:

a) a first element having a first axial well formed therein;

b) a second element having a second axial well formed therein, said first and second wells having a common axis, and said first and second elements having a variable relative angular relationship therebetween about said axis;

c) splines formed in one of said first and second wells;

d) threads formed in the other of said first and second wells;

e) a pin disposed in said apparatus and extending into each of said wells and having mating splines on a pin portion extending into said splined well and having mating threads on a pin portion extending into said threaded well;

f) a magnet disposed axially disposed on an end of said pin extending into said first well; and g) a Hall-effect sensor disposed adjacent said magnet outside of said first element for providing signals proportional to the axial position of said magnet in said first well, said signals representating the angular position of said first element with respect to said second element.

2. An apparatus in accordance with claim 1 wherein said other of said first and second wells is provided with an axial stud attached to a bottom of said well and wherein said threads are formed on said stud.

3. An apparatus in accordance with claim 1 wherein said first element is a cam phaser crankshaft subassembly and said second element is a cam phaser camshaft subassembly.

4. An apparatus in accordance with claim 3 further comprising an engine control module receivable of said signals from said sensor.

5. A multiple-cylinder internal combustion engine comprising a cam phaser, including a cam phaser crankshaft subassembly having a first axial well formed therein, a cam phaser camshaft subassembly having a second axial well formed therein, said first and second wells having a common axis, and said first and second subassemblies having a variable relative angular relationship therebetween about said axis, splines formed in one of said first and second wells, threads formed in the other of said first and second wells, a pin disposed in said cam phaser and extending into each of said wells and having mating splines on a pin portion extending into said splined well and having mating threads on a pin portion extending into said threaded well, a magnet disposed axially disposed on an end of said pin extending into said first well, and a Hall-effect sensor disposed adjacent said magnet outside of said cam phaser crankshaft subassembly for providing signals to an engine control module proportional to the axial position of said magnet in said first well, said signals representating the angular position of said cam phaser crankshaft subassembly with respect to said cam phaser camshaft subassembly.

* * * * *